US008001712B2

(12) United States Patent
Shea

(10) Patent No.: US 8,001,712 B2
(45) Date of Patent: Aug. 23, 2011

(54) OVERHEAD SIGNAGE SYSTEM

(75) Inventor: Thomas M Shea, Troy, MI (US)

(73) Assignee: T.M. Shea Products, Inc., Troy, MI (US)

( * ) Notice: Subject to any disclaimer, the term of this patent is extended or adjusted under 35 U.S.C. 154(b) by 1037 days.

(21) Appl. No.: 11/620,866

(22) Filed: Jan. 8, 2007

(65) Prior Publication Data

US 2007/0175151 A1 Aug. 2, 2007

Related U.S. Application Data

(60) Provisional application No. 60/756,879, filed on Jan. 6, 2006.

(51) Int. Cl.
*A47F 5/00* (2006.01)

(52) U.S. Cl. ..... 40/618; 211/87.01; 40/642.01

(58) Field of Classification Search ..... 40/605, 40/606, 642.01, 649; 211/189
See application file for complete search history.

(56) References Cited

U.S. PATENT DOCUMENTS 3,610,425 A * 10/1971 Madey ..... 248/220.22
4,405,051 A * 9/1983 Thalenfeld ..... 211/57.1
4,606,466 A * 8/1986 Fredrickson ..... 211/59.1
5,197,215 A * 3/1993 Torsleff ..... 40/654.01
5,437,116 A * 8/1995 Hardy ..... 40/605
5,511,332 A * 4/1996 Sturkie et al. ..... 40/661.03
5,660,286 A 8/1997 Shea
5,666,732 A 9/1997 Shea
5,957,422 A 9/1999 Shea
D422,483 S 4/2000 Shea
D422,886 S 4/2000 Shea
D423,857 S 5/2000 Shea
6,070,747 A 6/2000 Shea
D432,844 S 10/2000 Shea
D435,381 S 12/2000 Shea
D435,435 S 12/2000 Shea
6,199,706 B1 3/2001 Shea
6,202,866 B1 3/2001 Shea
6,349,909 B1 * 2/2002 Zarrow et al. ..... 248/220.41
D455,067 S 4/2002 Shea
D457,364 S 5/2002 Shea
D457,365 S 5/2002 Shea
D457,770 S 5/2002 Shea
6,390,337 B1 5/2002 Shea
D459,132 S 6/2002 Shea
D459,626 S 7/2002 Shea
D462,556 S 9/2002 Shea
D463,251 S 9/2002 Shea
D464,510 S 10/2002 Shea
D464,837 S 10/2002 Shea
D464,838 S 10/2002 Shea
D465,371 S 11/2002 Shea
D465,372 S 11/2002 Shea
D466,352 S 12/2002 Shea
D467,114 S 12/2002 Shea
D468,948 S 1/2003 Shea
D469,629 S 2/2003 Shea
6,533,134 B1 * 3/2003 Menaged et al. ..... 211/87.01
6,536,613 B2 3/2003 Shea (Continued)

*Primary Examiner* — Cassandra Davis
(74) *Attorney, Agent, or Firm* — Harness, Dickey & Pierce, P.L.C.

(57) ABSTRACT

A system for supporting one or more contiguous overhead signs or portions thereof. The system includes a plurality of sign support members, and a plurality of connectors for coupling adjacent support members along a common longitudinal axis. At least one connector is slidably receivable by the adjacent support members in corresponding channels thereon.

7 Claims, 16 Drawing Sheets

U.S. PATENT DOCUMENTS

| | | | | |
|---|---|---|---|---|
| D471,044 | S | | 4/2003 | Shea |
| D476,217 | S | | 6/2003 | Shea |
| D477,769 | S | | 7/2003 | Shea |
| D483,656 | S | | 12/2003 | Shea |
| 6,675,978 | B2 | | 1/2004 | Shea |
| D505,615 | S | | 5/2005 | Shea |
| 7,100,878 | B2 | | 9/2006 | Shea |
| 7,118,000 | B2 | | 10/2006 | Shea |
| 7,121,416 | B2 | | 10/2006 | Shea |
| D532,289 | S | | 11/2006 | Shea |
| D543,442 | S | | 5/2007 | Shea |
| D590,448 | S | * | 4/2009 | Dukes et al. ..... D20/42 |

* cited by examiner

OVERHEAD SIGNAGE SYSTEM

CROSS-REFERENCE TO RELATED APPLICATIONS

This application claims priority to U.S. Provisional Patent Application No. 60/756,879 filed Jan. 6, 2006 which application is herein expressly incorporated by reference.

INTRODUCTION

A multitude of product and product categories crowd the aisles and merchandise displays of retail stores. Overhead signs can be used to showcase products or product categories, attract attention and provide guidance to different sections of the store. Additionally, with fluctuating market demands, seasonal space requirements and influx of new products, there is a constant need to assemble, disassemble, change or remove overhead sign supports quickly and easily while attaining optimal visibility.

Although the existing overhead sign supports can be satisfactory for their intended purposes, there is still a need for overhead sign systems that are versatile, lightweight and easy to install, assemble and disassemble.

SUMMARY

The present teachings provide a system for supporting one or more contiguous overhead signs or portions thereof. The system includes a plurality of sign support members, and a plurality of connectors for coupling adjacent support members along a common longitudinal axis. At least one connector is slidably receivable by the adjacent support members in corresponding channels thereon.

In one aspect, an overhead sign system according to the present teachings can include at least one support members having a panel having first and second surfaces. The first surface can define a clip for supporting the sign. The second surface can define at least one longitudinal channel. The overhead sign system can further include at least one arm for supporting the support member on a support surface, and at least one connector slidably received in the longitudinal channel of the support member.

In another aspect, an overhead sign system according to the present teachings can include at least one pair of first and second longitudinal clip elements for holding the sign or portion thereof, at least one pair of first and second receiver elements, each receiver element having a longitudinal inner channel for receiving one of the clip elements therein, and having an outer channel, at least one hanger connector having an elongated projection received in outer channel, and at least one arm coupled to the hanger connector at a first end and to a support surface at a second end.

Further areas of applicability of the present invention will become apparent from the description provided hereinafter. It should be understood that the description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF VARIOUS ASPECTS

The following description is merely exemplary in nature and is in no way intended to limit the invention, its application, or uses.

Figure 1A:
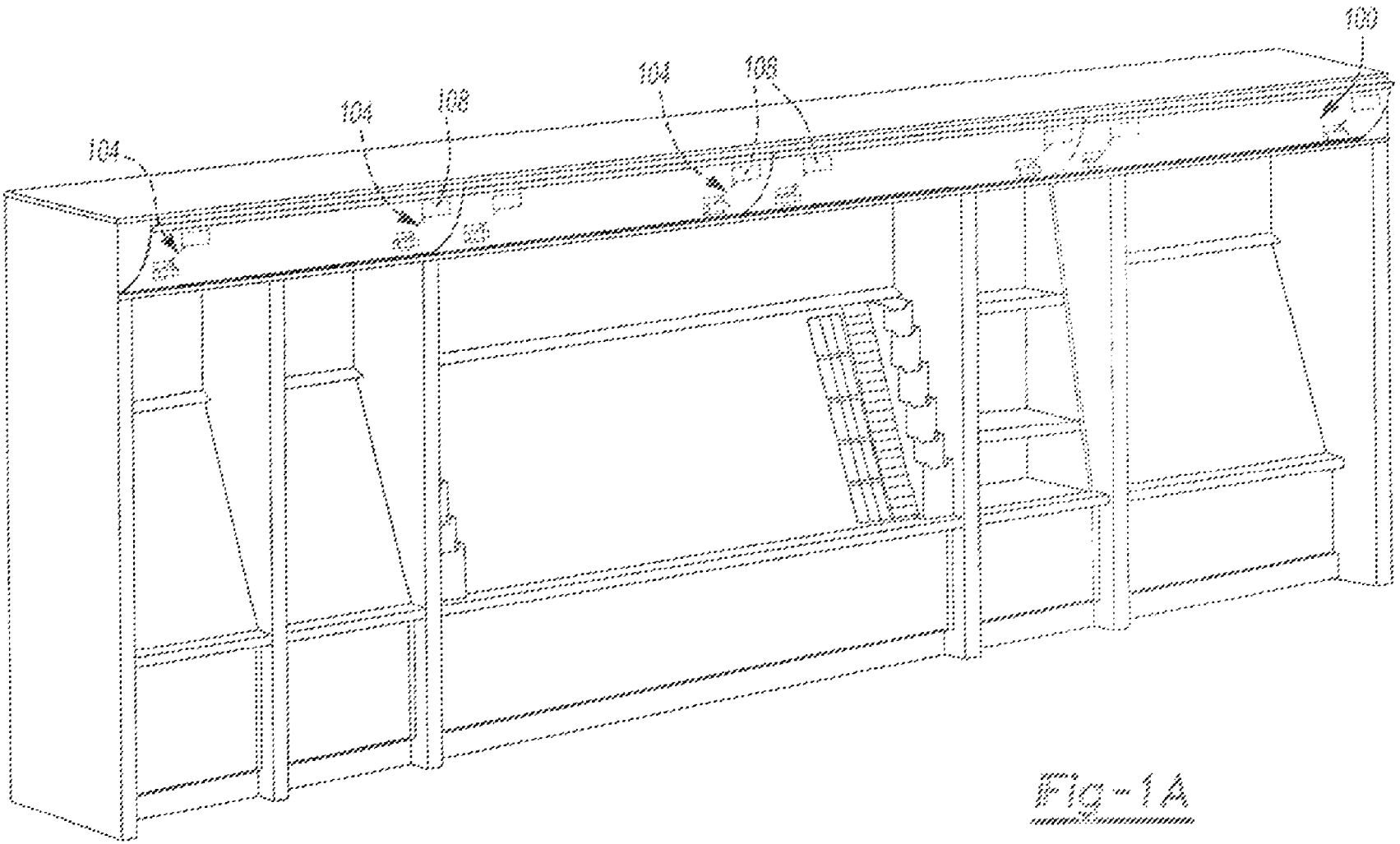
FIG. 1A is a perspective view of an overhead signage system according to the present teachings, the system shown above a merchandise display.
Figure 1B:
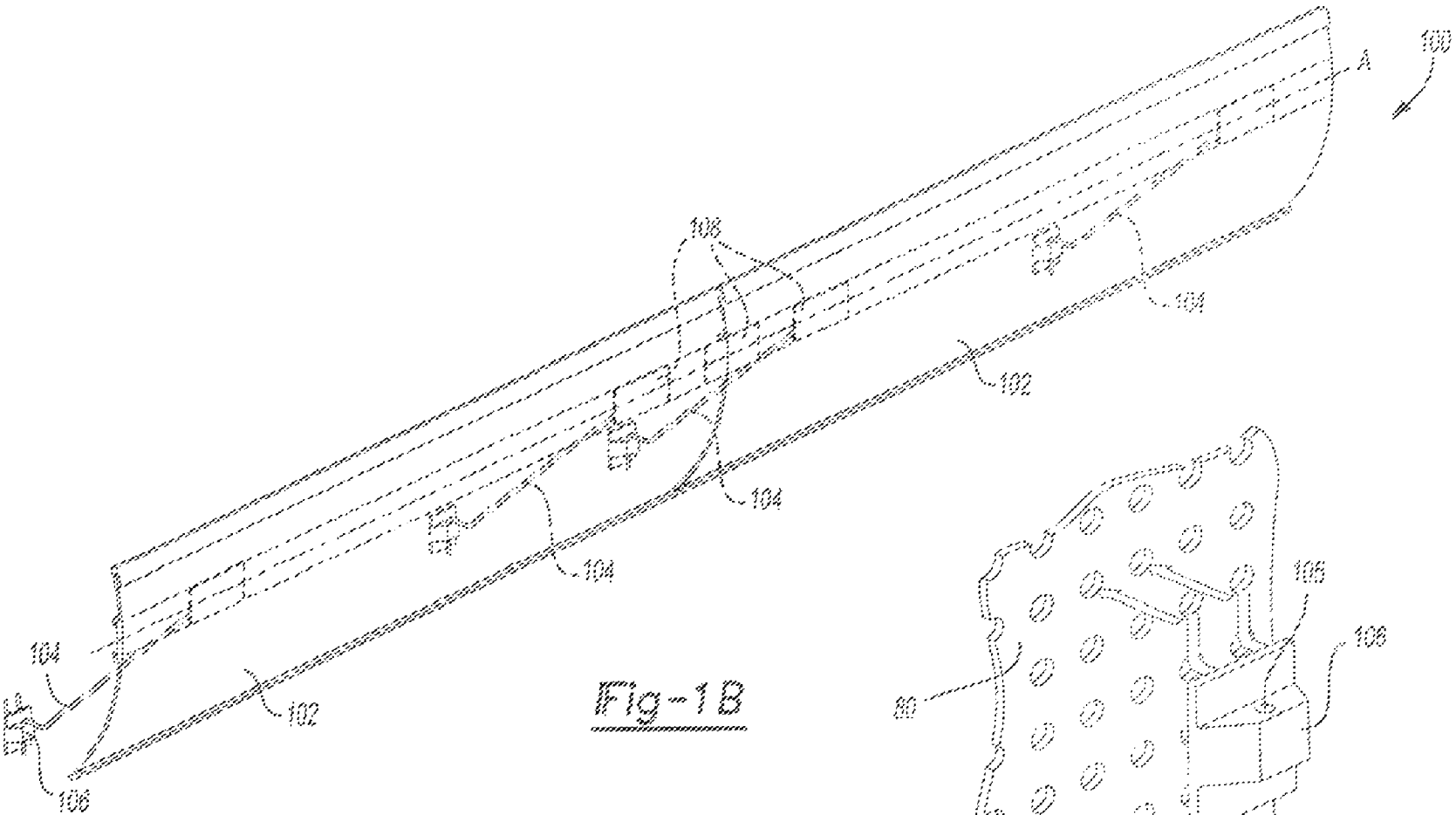
FIG. 1B is a perspective view of an overhead signage system according to the present teachings.

Referring to FIG. 1A, an exemplary overhead signage system 100 according to the present teachings is shown in connection with a merchandise display. The overhead signage system 100 can be used to support one or more signs 82, or contiguous portions thereof. Referring to FIGS. 1B and 2A-E, the overhead signage system 100 can include one or more support members 102 having a longitudinal axis A, and a plurality of arms 104 coupled to the support members 102. Referring to FIGS. 3A-C, each support member 102 can be an integral panel, substantially flat or curved, and having front and back surfaces 113, 117. The front surface 113 can include folded edges 112 defining a C-shaped clip 111 for holding the sign 82 or portion thereof. The back surface 117 can include one or more longitudinal channels 114 defined on a channel structure 115 of the back surface 117, as shown in FIGS. 3A-C. The channels 114 can slidably receive connectors 108 coupling the arms 104 to the support members 102, and/or coupling adjacent support members 102 to each other, as discussed below.

Referring to FIGS. 2A-E, the arms 104 can be configured for hanging the sign 82 on the support members 102 at an angle $\alpha$ relative to a support surface 80 or relative to a surface of the connector 108. The support surface 80 can be a wall, a pegboard, or other surface adjacent to the merchandise display. Each arm 104 can be a wire or other thin elongated member which can be straight or piecewise straight, although curved members can also be used. The arm 104 can include first and second ends 104*a*, 104*b* and a central portion 104*c*. the first end 104*a* can be configured to be removably received in a bore 105 of a mounting bracket 106. The arm 104 can include an end segment 110 adjacent to the first end 104*a*, which can be angled relative to the central portion 104*c* in or out of plane relative to central portion 104*c* such that the arm 104 can be positioned at a desired angle relative to the support surface 80. Further, the end segment 110 can be pivotably received in the bore 105 for allowing the arm 104 to rotate relative to the mounting bracket 106.

The second end 104*b* of the arm 104 can be modularly or integrally coupled to one of the connectors 108. The connector 108 can be a plate or other element configured to be slidably received in one of the channels 114 of the support member 102, as illustrated in FIGS. 2D, and 3A-B. Additionally, the connector 108 can be used independently of the arm 104 for connecting two adjacent support members 102 to each other, as illustrated in FIG. 2E, showing one of the connector 108 at least partially received in the channels 114 of two adjacent support members 102.

Figure 2A:
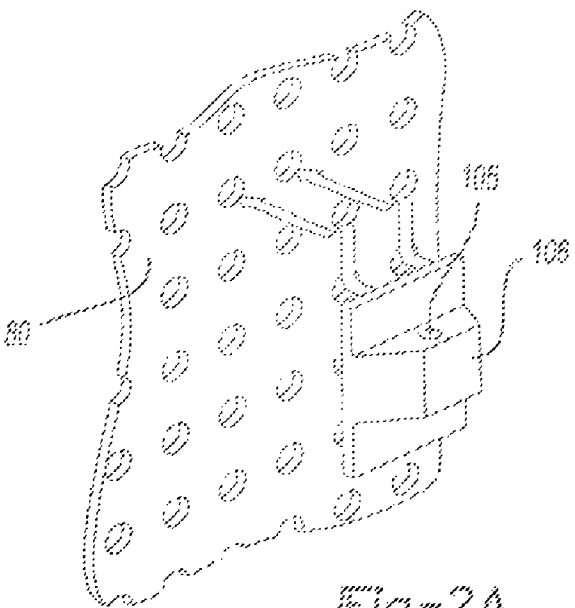
FIGS. 2A-E illustrate assembly and installation procedures the overhead signage system of FIG. 1B.
Figure 2B:
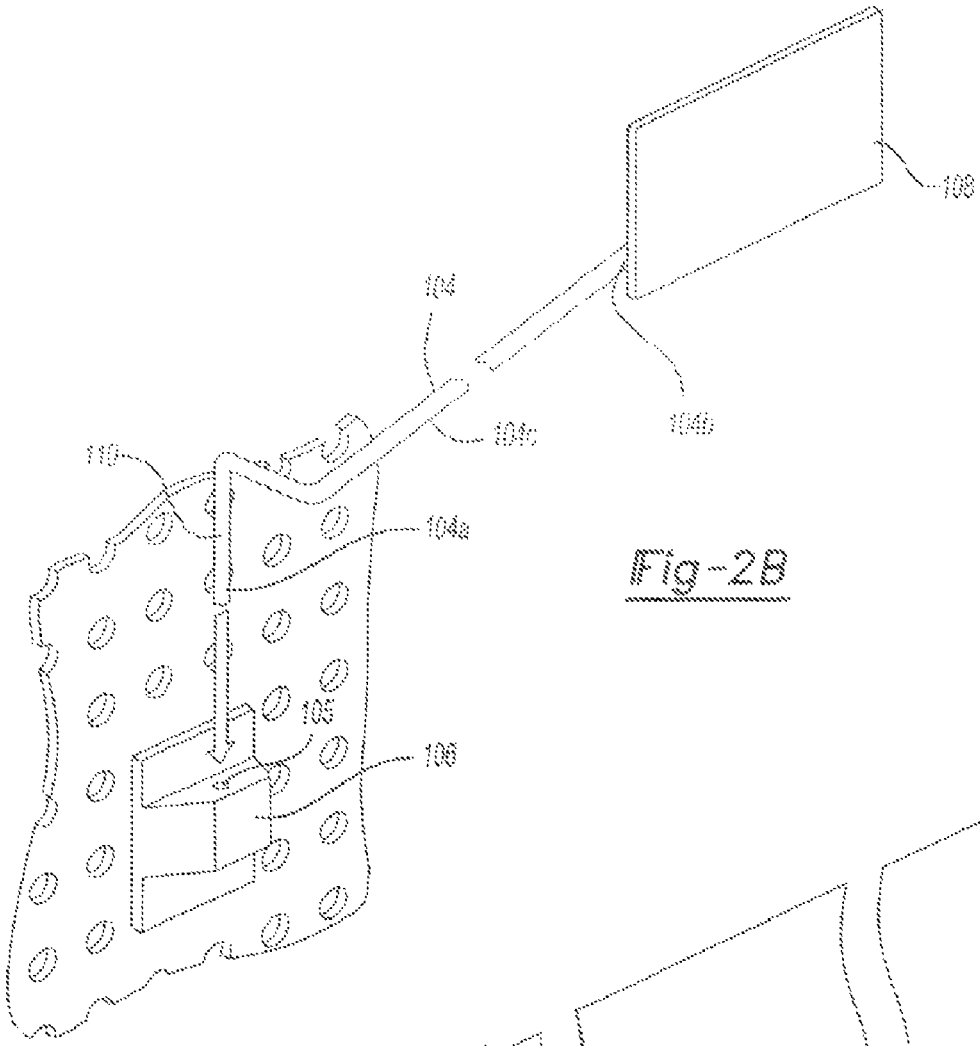
Figure 2C:
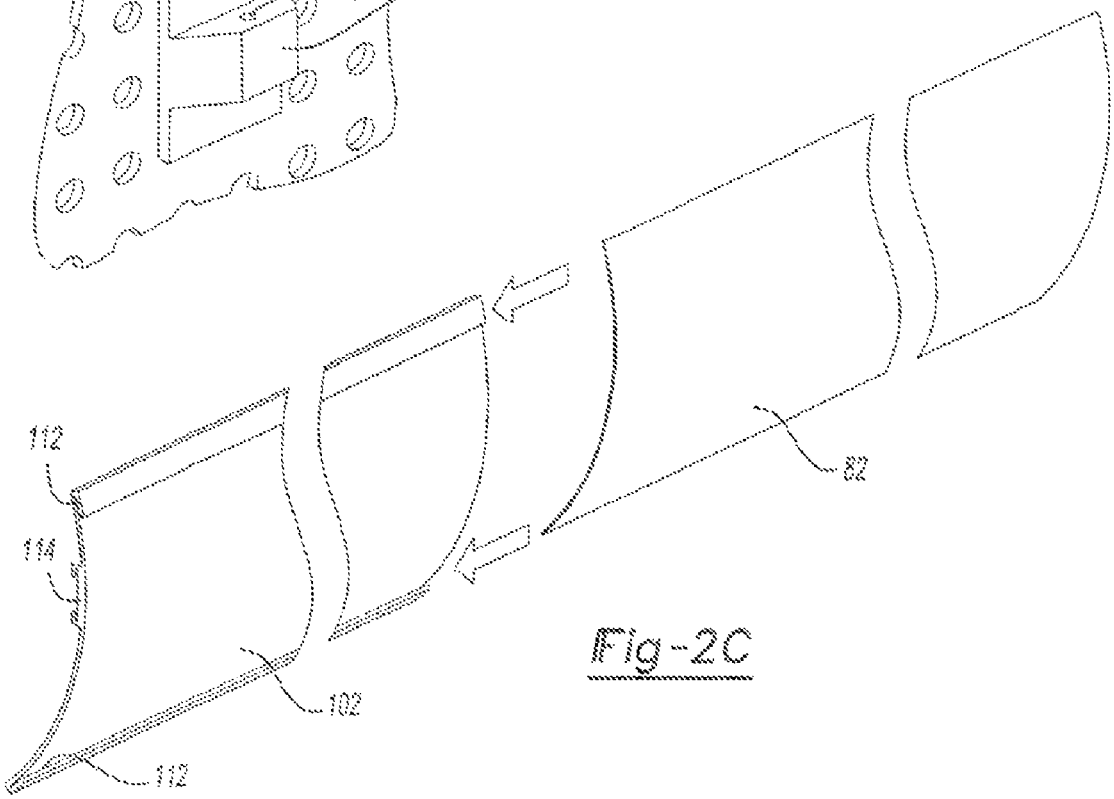
Figure 2D:
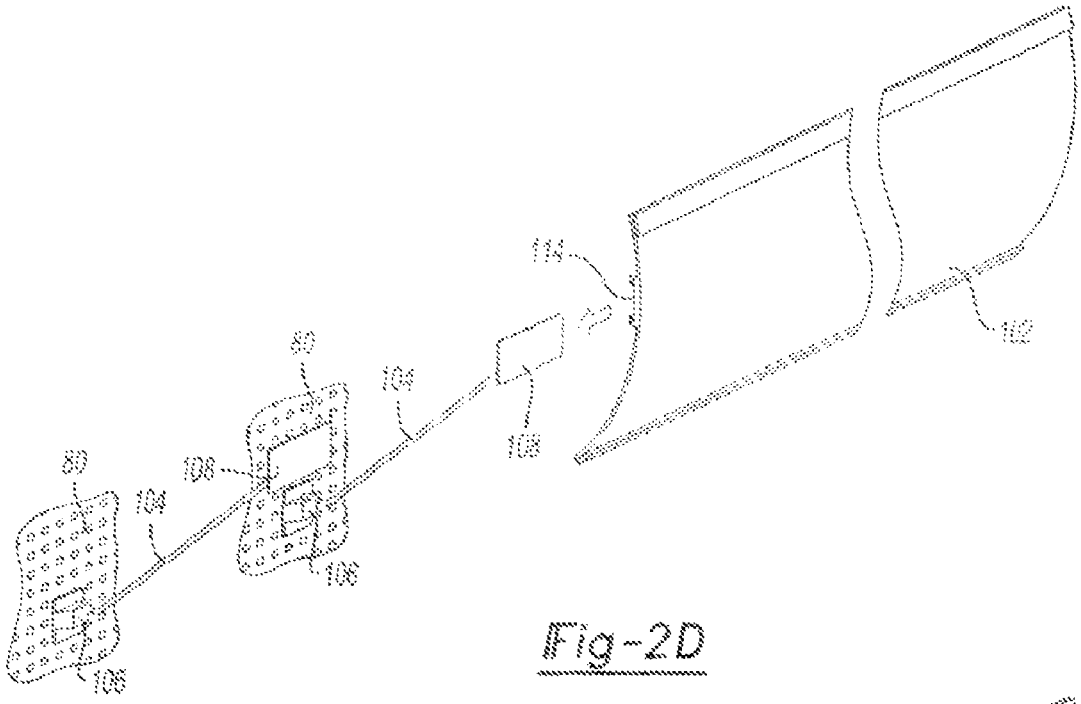
Figure 2E:
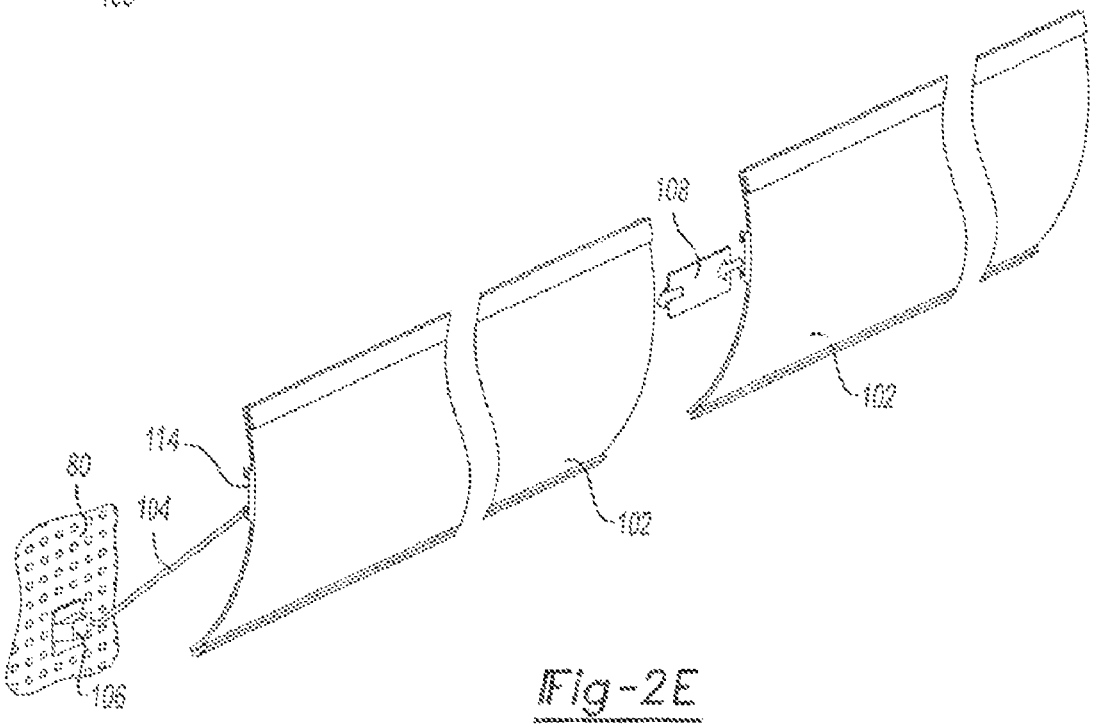
Figure 3A:
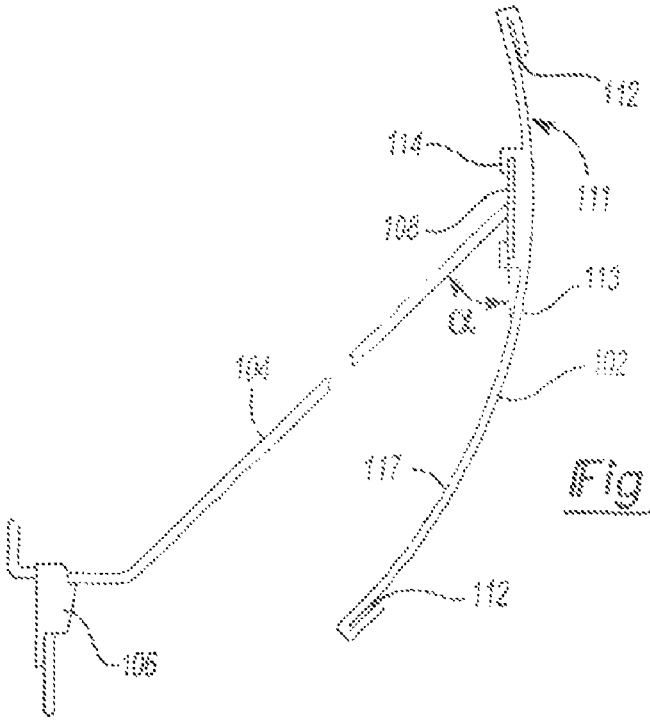
FIG. 3A is a side view of a detail of an overhead signage system according to the present teachings.
Figure 3B:
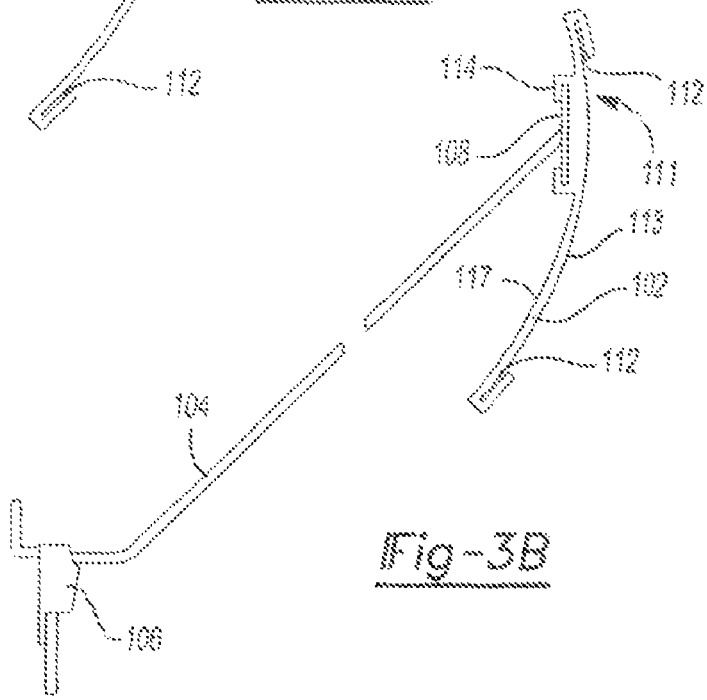
FIG. 3B is a side view of a detail of an overhead signage system according to the present teachings.
Figure 3C:
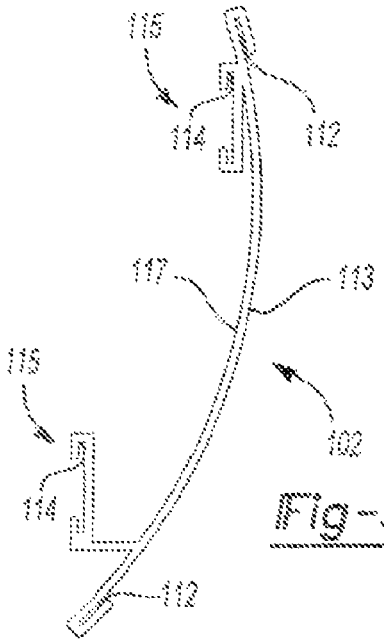
FIG. 3C is a side view of a detail of an overhead signage system according to the present teachings.

The overhead signage system 100 can be assembled and installed as illustrated in FIGS. 2A-E. The mounting brackets 106 can be inserted into the pegboard or otherwise mounted on the support surface 80 at desired distances therebetween, and in one or more rows corresponding to the number of channels 114 of the support members 102, as shown in FIG. 2A. The arms 104 can be removably coupled to the mounting brackets 106 by inserting the corresponding end segments 110 into the bores 105, as shown in FIG. 2B. The sign 82 can be inserted into the C-shaped clip 111 of the support member 102, as shown in FIG. 2C. The connectors 108 of the arms 104 can be inserted into the channel 114 of the support member 102, as shown in FIG. 2D. Two support members 102 can be connected longitudinally to each other by inserting a common connector 108 at adjacent ends of their channels 114, as shown in FIG. 2E.

The support members 102 can be made of molded plastic, composite or other material in various sizes and shapes, as shown in FIGS. 3A-C. The arms 104, the connectors 108 and the brackets 106 can be metallic or made from other suitable material, and can also be provided in various sizes and shapes.

Figure 4A:
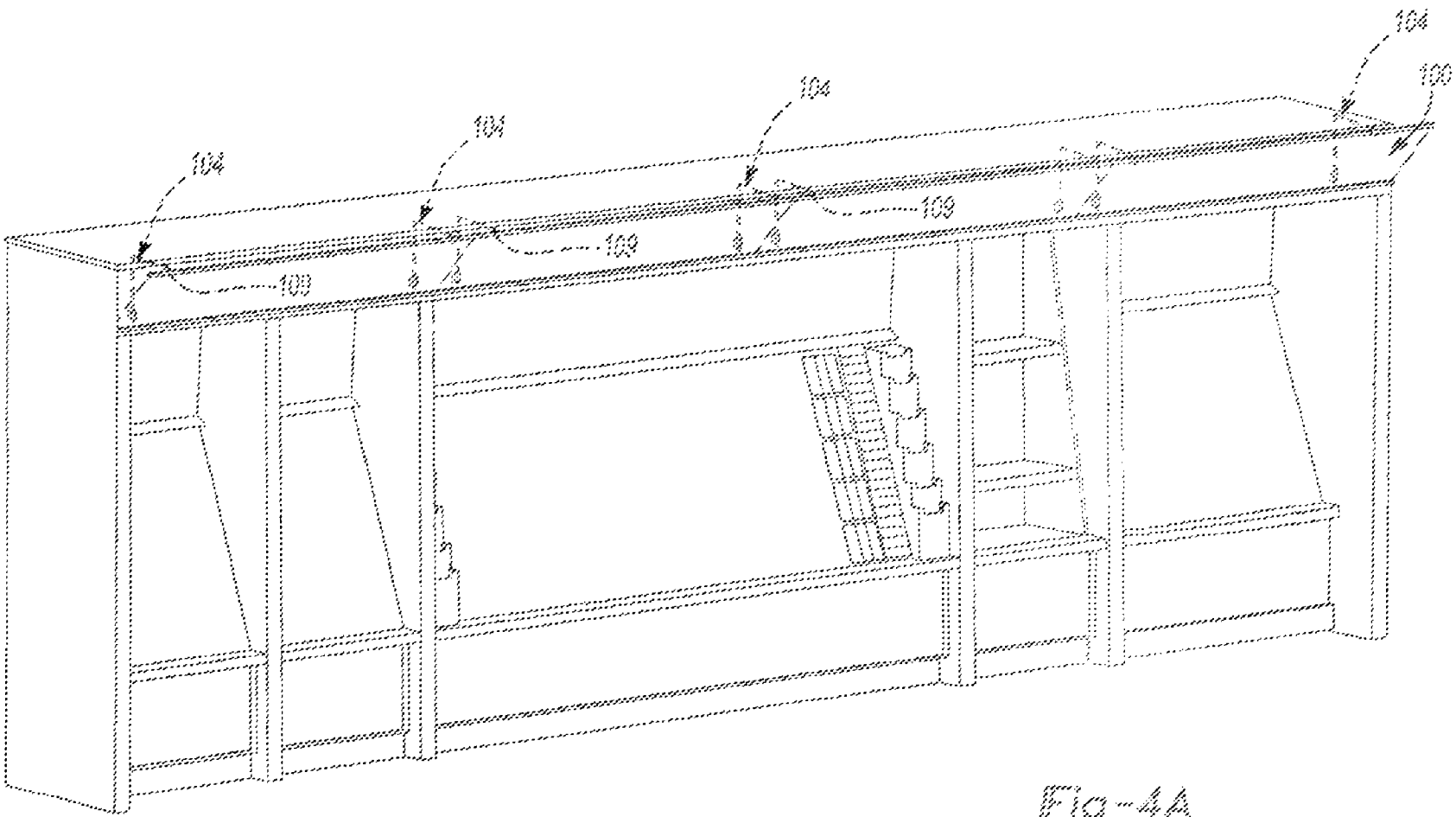
FIG. 4A is a perspective view of an overhead signage system according to the present teachings, the system shown above a merchandise display.
Figure 4B:
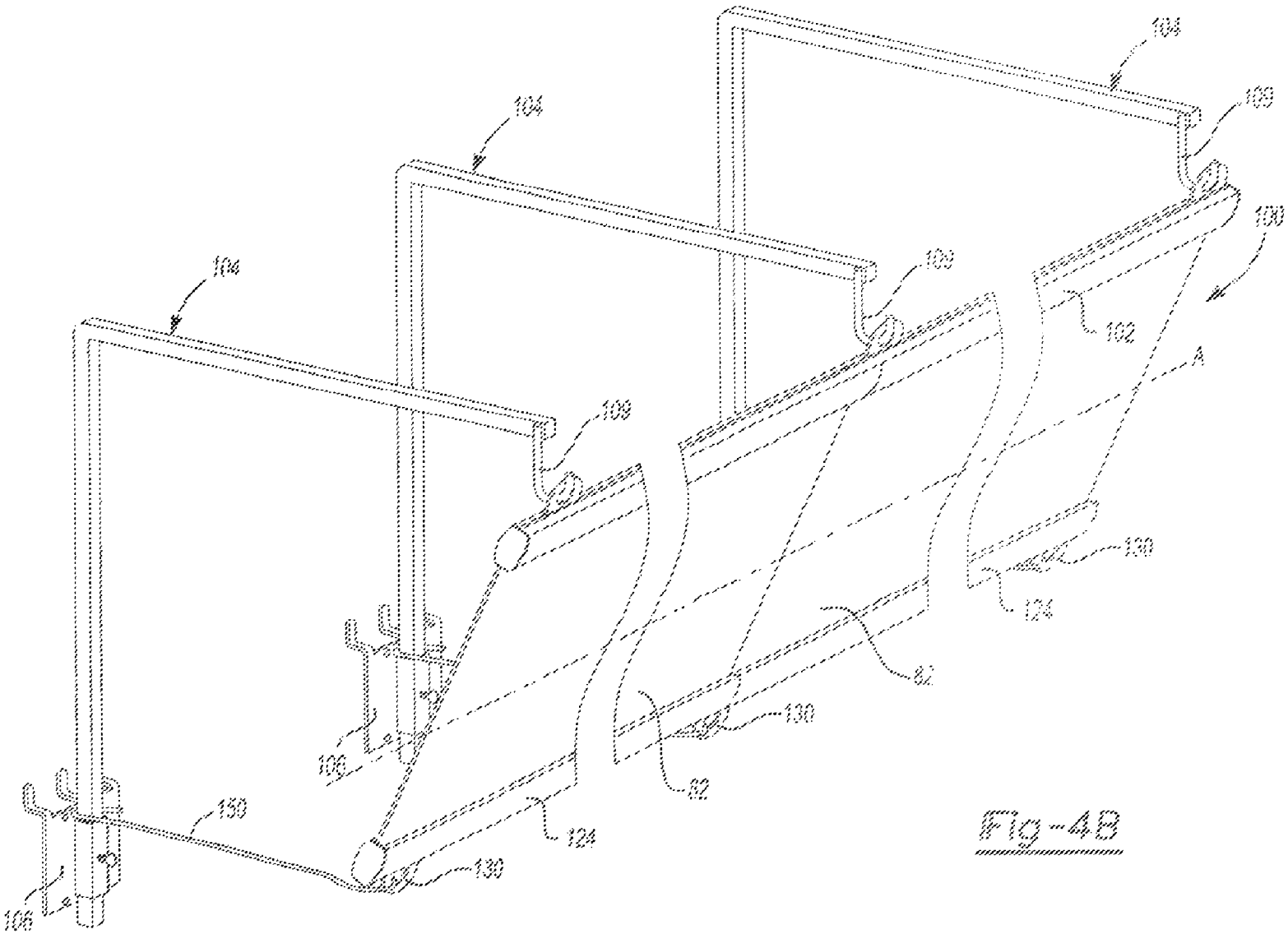
FIG. 4B is a perspective view of an overhead signage system according to the present teachings.
Figure 5A:
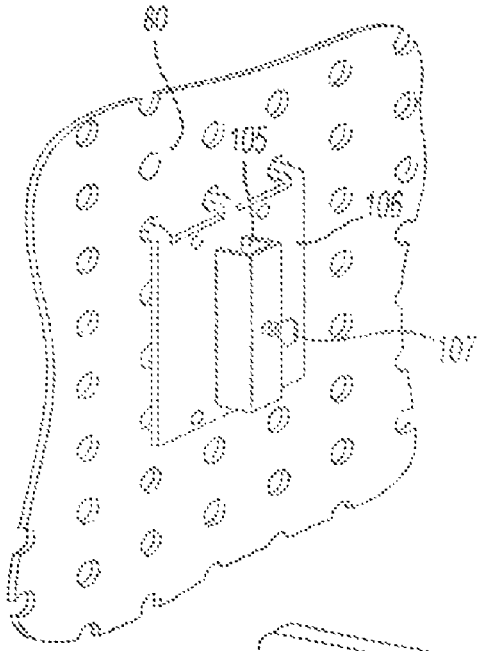
FIGS. 5A-E illustrate assembly and installation procedures for the overhead signage system of FIG. 4B.
Figure 5B:
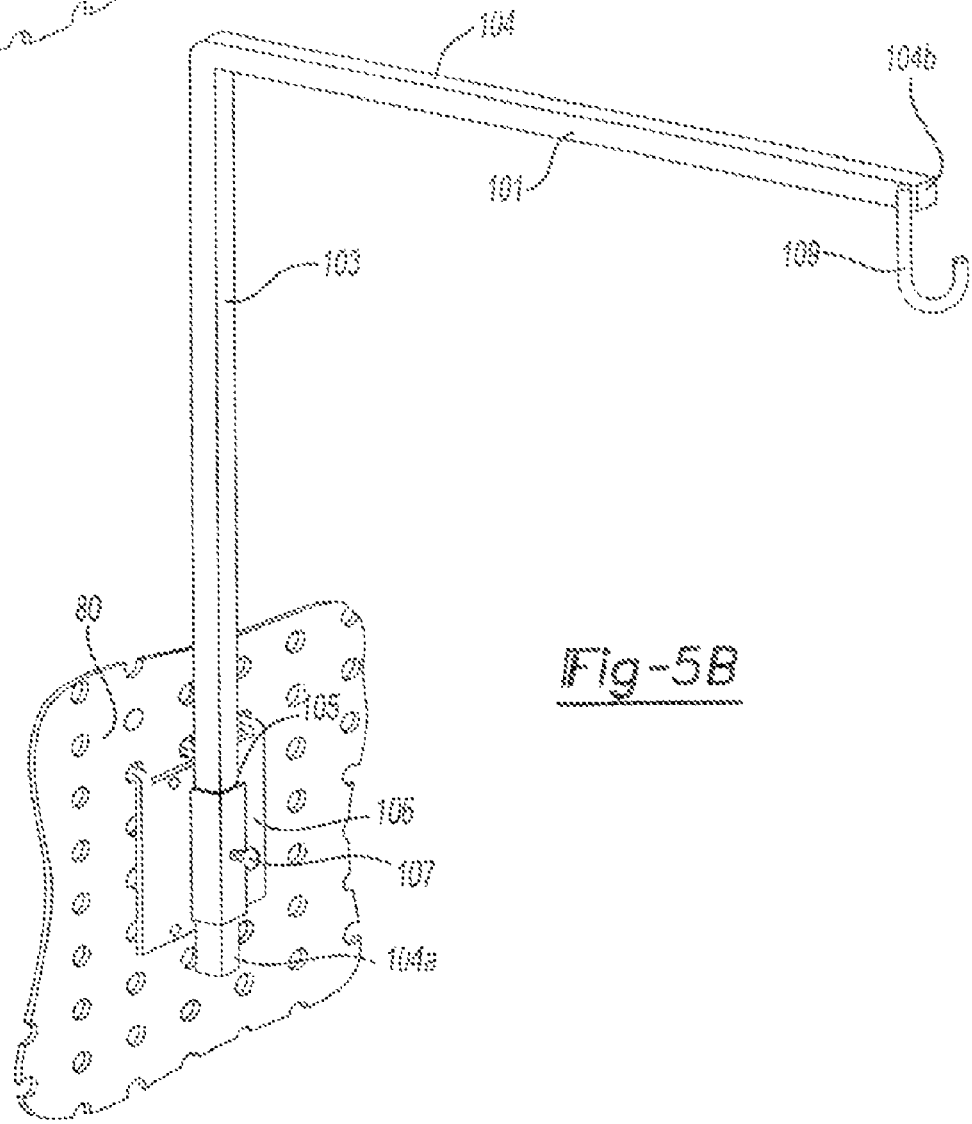
Figure 5C:
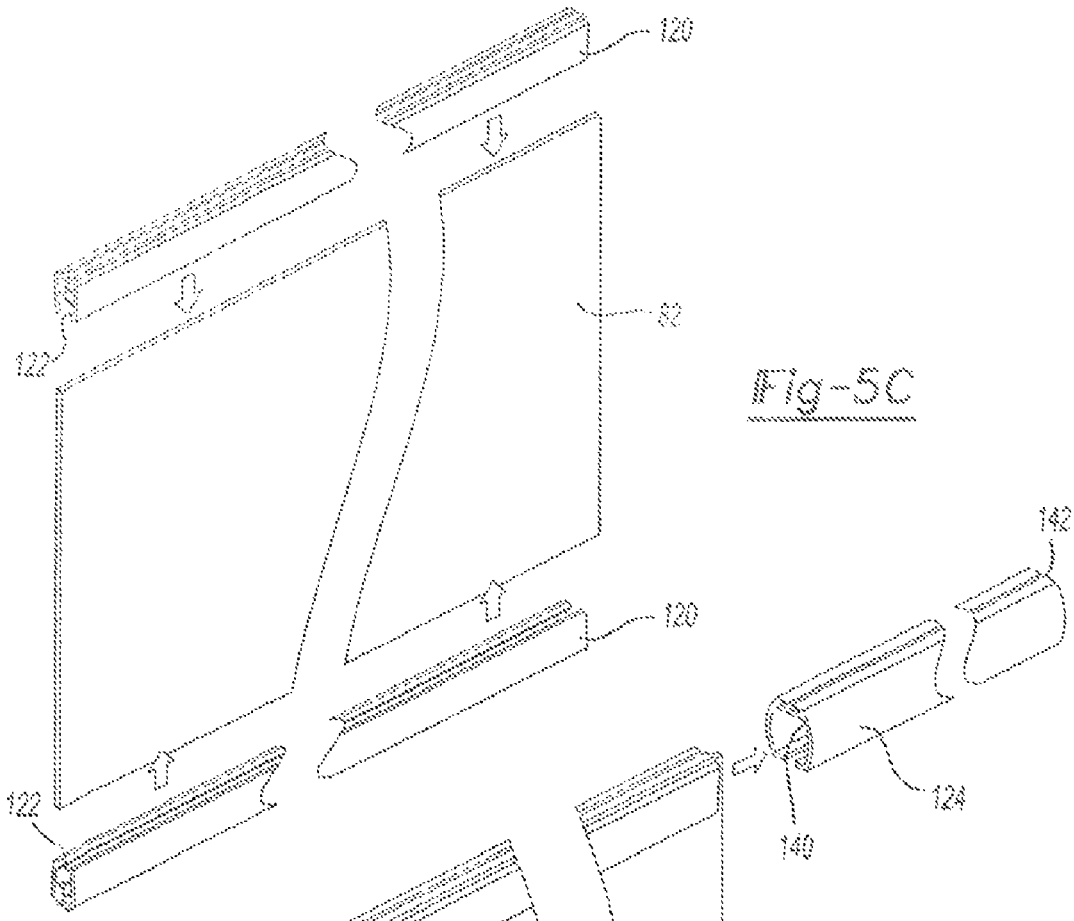
Figure 5D:
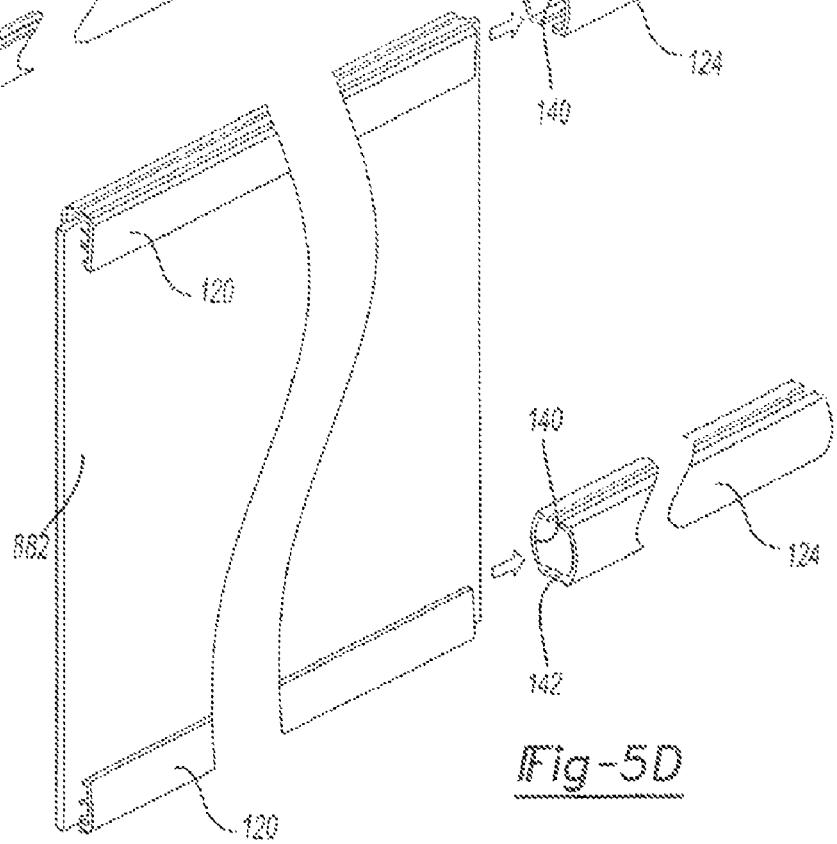
Figure 5E:
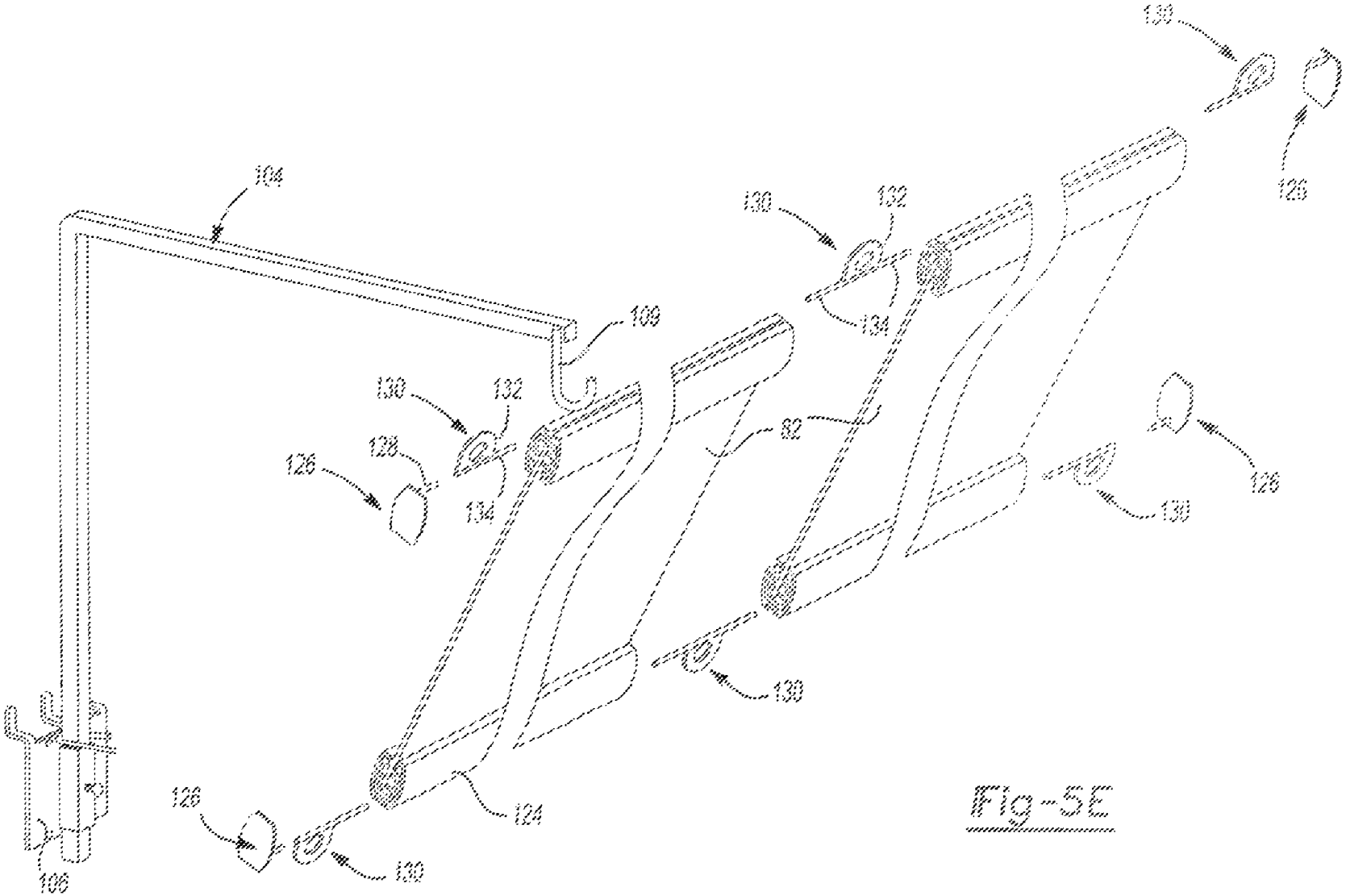

In one aspect, as illustrated in FIGS. 4A-B and 5A-E, the support members 102 can be modular and include two (upper and lower) separate and substantially parallel elongated clip elements 120, and two (upper and lower) elongated receiver elements 124, as illustrated in FIGS. 5C and 5D. The clip elements 120 can include inner grooves 122 for receiving the sign 82 without any back panels, or other supports. The clip elements 120 can be received into U-shaped channels or other inner channels 140 defined by the receiver elements 124 and configured to slidably receive and support the clip elements 120 therein. End covers 126 can be coupled to the free ends of the support members 102 to secure the clip elements 120 into the receiver elements 124, preventing relative sliding and providing a neat and finished appearance, as shown in FIGS. 5E and 4B. The end cover 126 can include one-sided pins or other projections 128 which can be inserted in outer grooves/slots/channels 142 of the receiver elements 124. Hanger connectors 130 having openings 132 and one- or two-sided oppositely extending pins or projections 128 can be slidably received in the outer grooves 142 of the receiver elements 124. The hanger connectors 130 can be used for coupling the arms 104 with the support members 102 and/or couple two adjacent support members 102 to each other, as shown in FIGS. 4B and 5E.

The support members 102 with the sign 82 attached therebetween can be supported by angled support arms 104, which can be substantially L-shaped and including first and second substantially orthogonal arm portions 103, 101. The free end 104*b* of the second arm section 101 can be coupled to a hook or other hanging device 109, as shown in FIG. 5B. The free end 104*a* of the first arm portion 103 can be removably received in the bore 105 of the mounting bracket 106 and secured in position with a thumbscrew 107.

The overhead signage system 100 of FIG. 4A-B can be assembled and installed as illustrated in FIGS. 5A-E. The mounting brackets 106 can be inserted into the pegboard or otherwise mounted on the support surface 80 at desired distances therebetween at the same height in one row, as shown in FIG. 5A. The arms 104 can be coupled to the mounting brackets 106 by inserting their first ends 104*a* into the bores 105, as shown in FIG. 5B. The sign 82 can be installed between the clip elements 120, as shown in FIG. 5C. The clip elements 120 with the sign 82 supported therebetween can be coupled to the receiver elements 124, as shown in FIG. 5D. The end covers 126 and the hanger connectors 130 can be coupled to the support members 102, as shown in FIG. 5E. The hooks 109 can be coupled to the openings 132 of the hanger connectors 130 for hanging the support members 102, as shown in FIG. 4B. Elongated lower arms 150 can be used for coupling lower hanger connectors 130 to the mounting brackets 106. The lower arms 150 can be, for example, wire elements terminating in wire hooks, and can be sized to hang the sign 82 at an angle appropriate for enhancing visibility and readability of the sign, as shown in FIGS. 4A-B. The angled arms 104 and the support members 102 can be made of lightweight strong material, such as aluminum or other metal, although plastics or composites can also be used. The angled arms 104 can be raised or lowered to provide a continuous signage surface with a common longitudinal axis A.

The overhead signage system 100 of the present teachings is a flexible and lightweight system that can be used in many retail applications, allowing for eye-catching overhead graphics or other signage that can be placed in many sections of a store. The overhead signage system 100 can be provided with modularly connected support members 102 appropriate for accommodating signs of various lengths or contiguous signs. Further, the overhead signage system 100 can be easily assembled and disassembled, moved to new location and re-assembled in the same or different configuration.

Figure 6A:
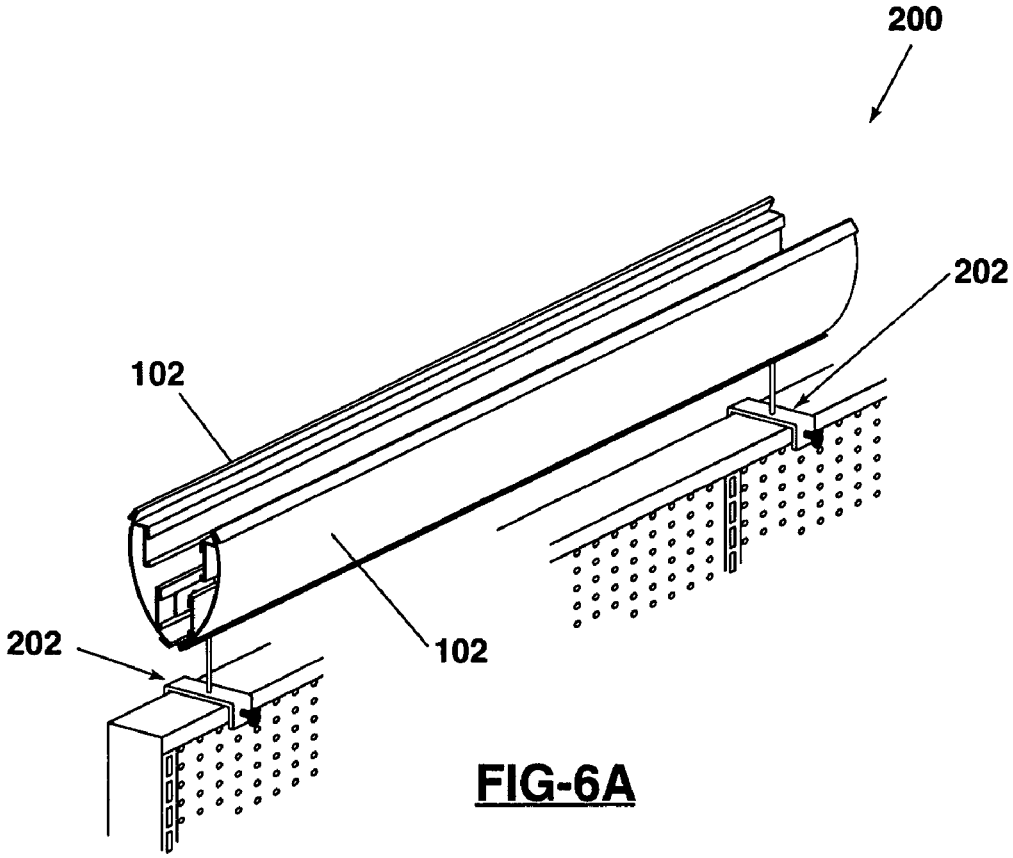
FIG. 6A is a perspective view of another overhead signage system according to the present teachings.
Figure 6B:
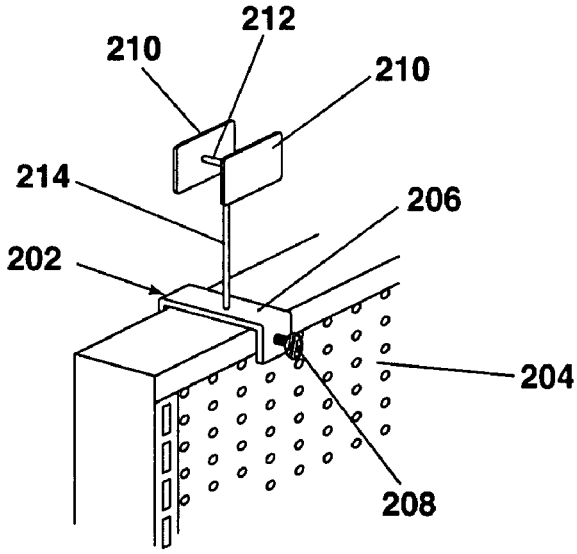
FIG. 6B is a perspective view similar to FIG. 6A shown with a portion of the overhead signage system removed for purposes of illustration.

Turning to FIGS. 6A and 6B, another overhead signage system in accordance with the present teachings is illustrated and identified at reference character 200. Like reference characters will be used to identify similar elements to those previously introduced. The system 200 may include a pair of mounting members 202. As illustrated, the mounting members 202 may be secured to an upper end of a pegboard wall 204. The mounting members 202 may include a lower portion 206 defining a generally C-shaped opening for receiving the upper end of the wall 204. The lower portion 206 may be secured to the wall 204 with a thumbscrew 208 or other similar structure.

The mounting members 202 may additionally include an upper end having one or more mounting flanges 210. As shown in FIG. 6B, the upper end may include a pair of mounting flanges 210. Each mounting flange 210 may be adapted to be received with in a channel 114 defined in a rear surface of a support member 102, for example. The flanges 210 may be connected to each other through a link 212 and in turn connected to the lower portion 206 through another link 214. Two or more mounting members 202 may be used to support one or two support members 102.

Figure 7A:
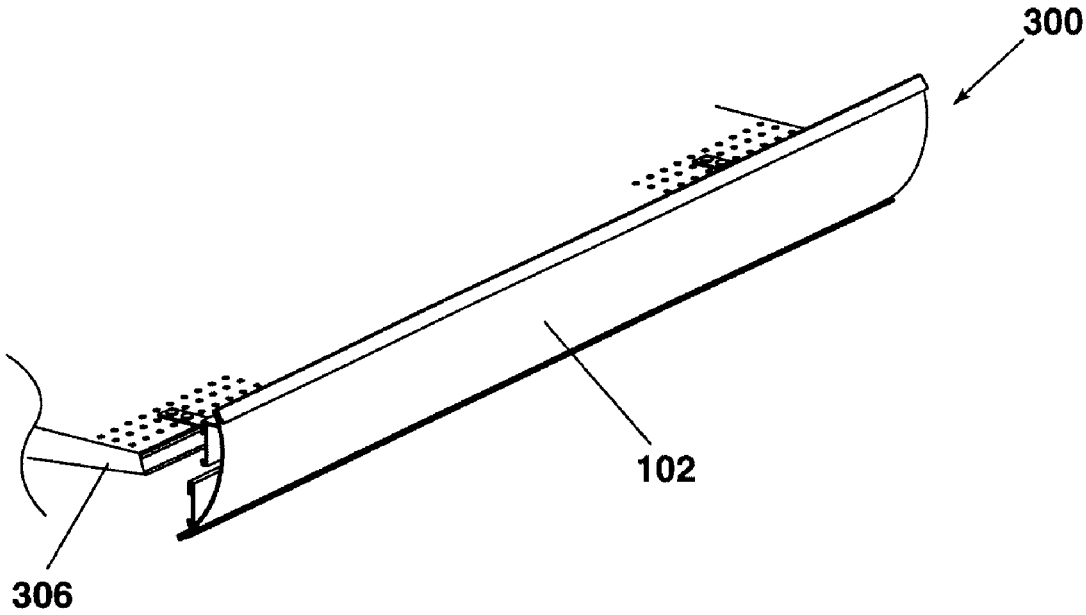
FIG. 7A is a perspective view of another overhead signage system according to the present teachings.
Figure 7B:
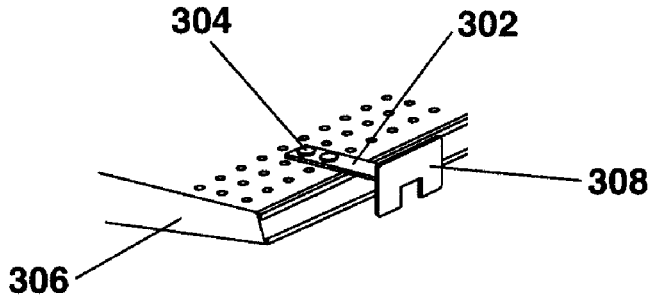
FIG. 7B is a perspective view similar to FIG. 7A shown with a portion of the overhead signage system removed for purposes of illustration.

Turning to FIGS. 7A and 7B, another overhead signage system in accordance with the present teachings is illustrated and identified at reference character 300. Like reference characters will be used to identify similar elements to those previously introduced. The system 300 may include one or more shelf mounting members 302 and a support member 102. The shelf mounting member 302 includes a first end 304 for attachment to a shelf 306 and a second end carrying a mounting flange 308. The mounting flange 308 is adapted to be received with in a channel 114 defined in a rear surface of a support member 102, for example.

Figure 8A:
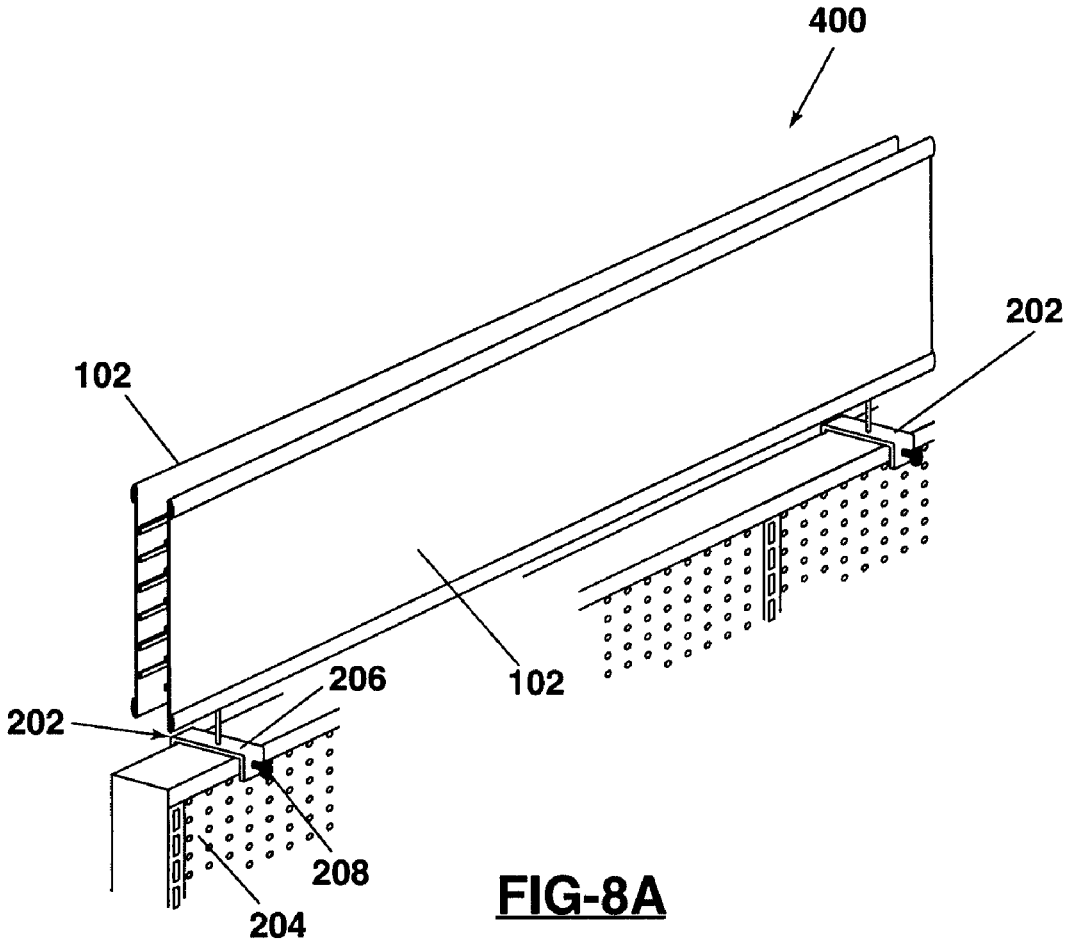
FIG. 8A is a perspective view of another overhead signage system according to the present teachings.
Figure 8B:
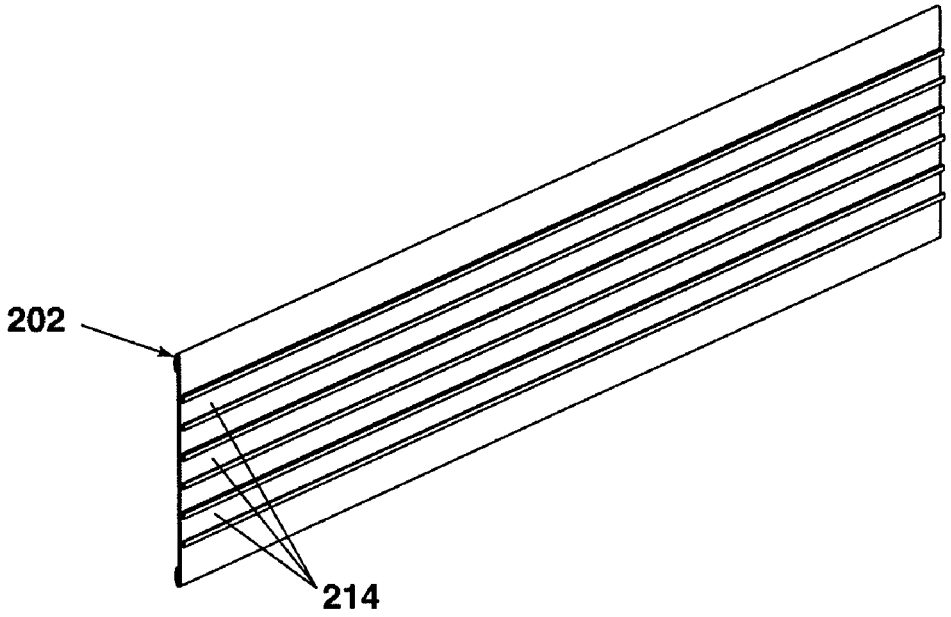
FIG. 8B is a rear perspective view of one of the headers of FIG. 8A.

Turning to FIGS. 8A and 8B, another overhead signage system in accordance with the present teachings is illustrated and identified at reference character 400. Like reference characters will be used to identify similar elements to those previously introduced. The system 400 may include a pair of mounting members 202. As illustrated, the mounting members 202 may be secured to an upper end of a pegboard wall 204. The mounting members 202 may include a lower portion 206 defining a generally C-shaped opening for receiving the upper end of the wall 204. The lower portion 206 may be secured to the wall 204 with a thumbscrew 208 or other similar structure. As with the system 200, the mounting members 202 may additionally include an upper end having a pair of mounting flanges 210. Each mounting flange 210 may be adapted to be received with a channel 114 defined in a rear surface of a support member 102, for example.

Figure 9A:
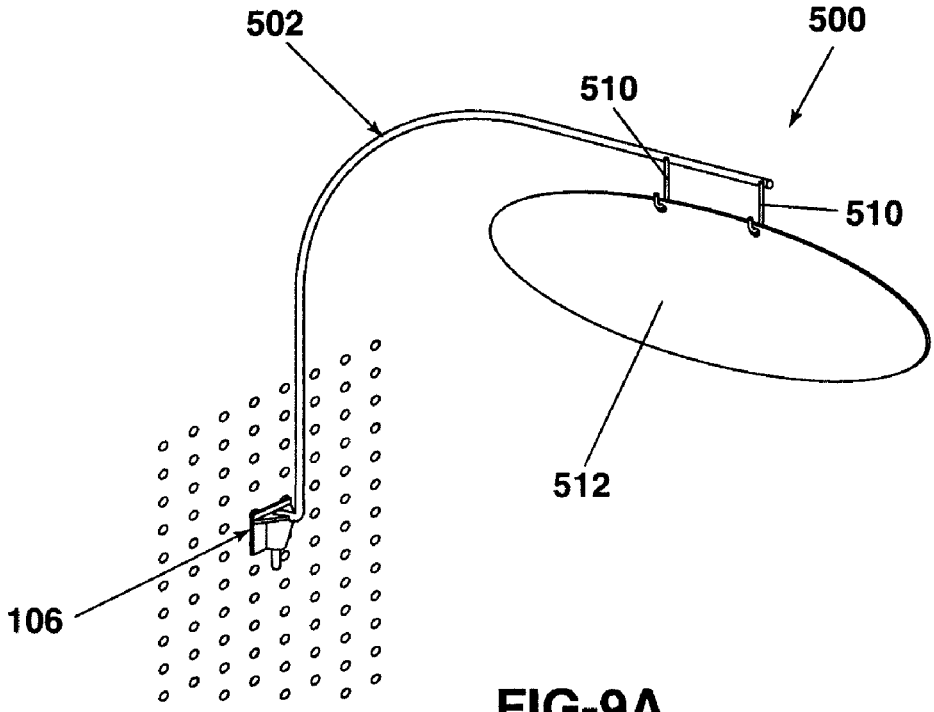
FIG. 9A is a perspective view of another overhead signage system according to the present teachings, the overhead signage system shown mounted to a pegboard.
Figure 9B:
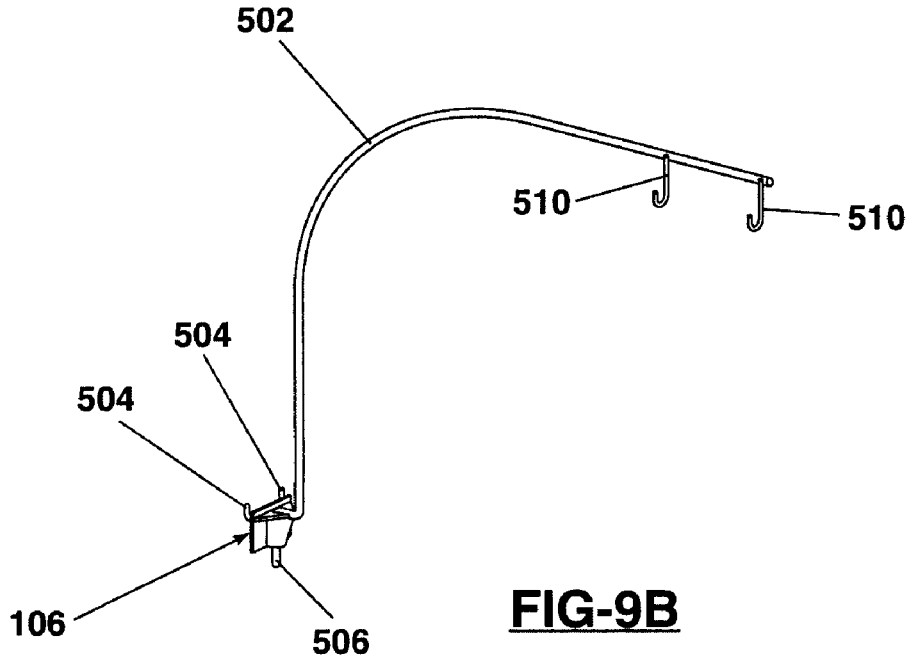
FIG. 9B is a perspective view of a portion of the overhead signage system of FIG. 9A shown removed from the pegboard for purposes of illustration.

Turning to FIGS. 9A and 9B, another overhead signage system in accordance with the present teachings is illustrated and identified at reference character 500. Like reference characters will be used to identify similar elements to those previously introduced. The system 500 may include a wire arm 502. The wire arm 502 may be secured at a first end to the pegboard wall 204 with a bracket 106. The bracket 106 may include a pair of upwardly extending prongs 504 and a lower extending prong 506 for engaging holes of the pegboard wall 204. The wire arm 502 may be welded or otherwise permanently or removably secured to the bracket 106. A distal end of the wire arm 502 may carry one or more hooks 510 for supporting a sign 512.

Figure 10A:
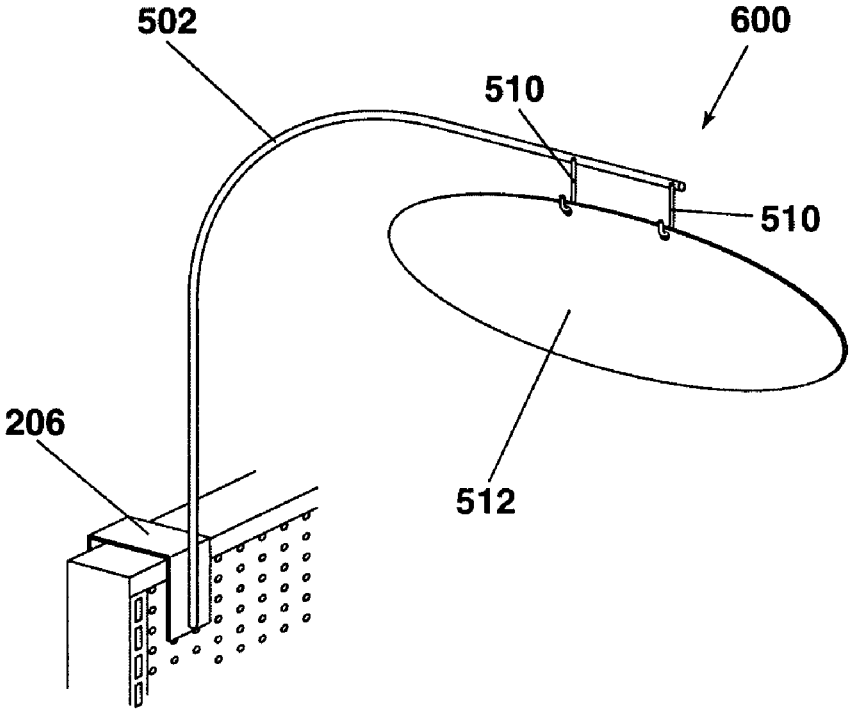
FIG. 10A is a perspective view of another overhead signage system according to the present teachings.
Figure 10B:
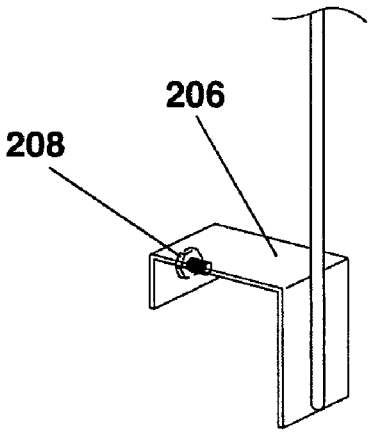
FIG. 10B is a perspective view of a portion of the overhead signage system of FIG. 10A.

Turning to FIGS. 10A and 10B, another overhead signage system in accordance with the present teachings is illustrated and identified at reference character 600. Like reference characters will be used to identify similar elements to those previously introduced. The system 600 may include a wire arm 502. The wire arm 502 may be secured at a first end to a C-shaped member 206 for engaging an upper end of a pegboard wall 204. The member 206 may be secured with a thumb screw 208. The wire arm 502 may be welded or otherwise permanently or removably secured to the member 206. A distal end of the wire arm 502 may carry one or more hooks 510 for supporting a sign 512.

Figure 11:
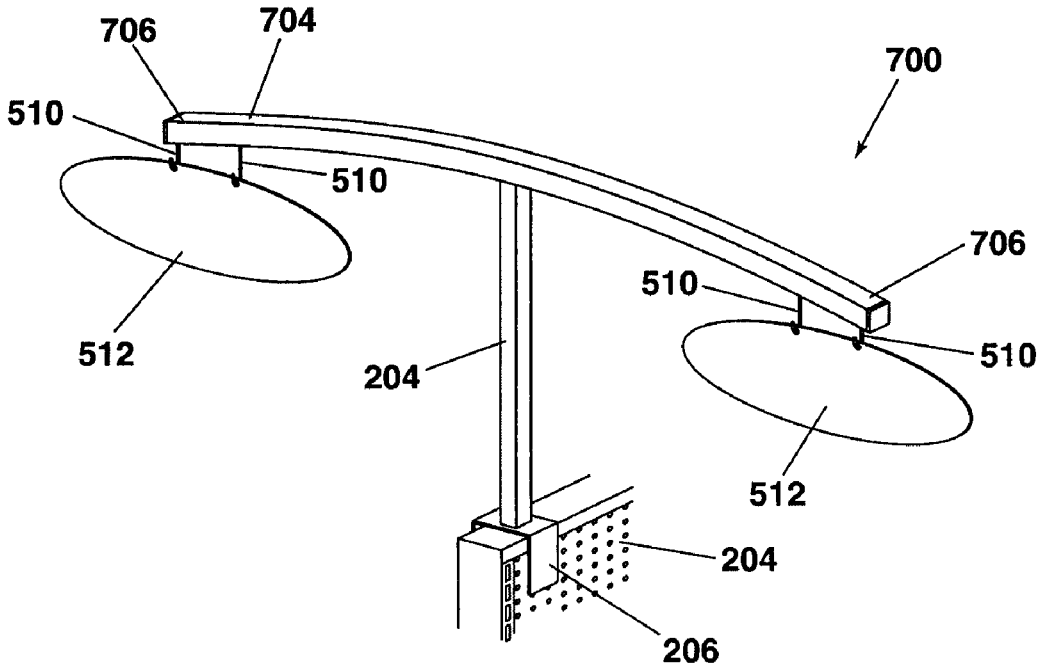
FIG. 11 is a perspective view of another overhead signage system according to the present teachings.

Turning to FIG. 11, another overhead signage system in accordance with the present teachings is illustrated and identified at reference character 700. Like reference characters will be used to identify similar elements to those previously introduced. The system 700 may include a tubular arm 702. The tubular arm 702 may have a generally rectangular cross section and may be secured at a lower end to a C-shaped member 206 for engaging an upper end of a pegboard wall 204. The member 206 may be secured with a thumb screw. The tubular arm 702 may be welded or otherwise permanently or removably secured to the member 206. An upper end of the tubular arm 702 may be secured to a generally horizontal arm 704. The arms 702 and 704 may be welded or otherwise secured to one another. The arm 704 may be slightly arcuate in shape such that ends 706 of the arm 704 is slightly displaced downwardly from a center of the arm 704. The ends 706 may each carry one or more hooks 510 for supporting a sign 512.

Figure 12:
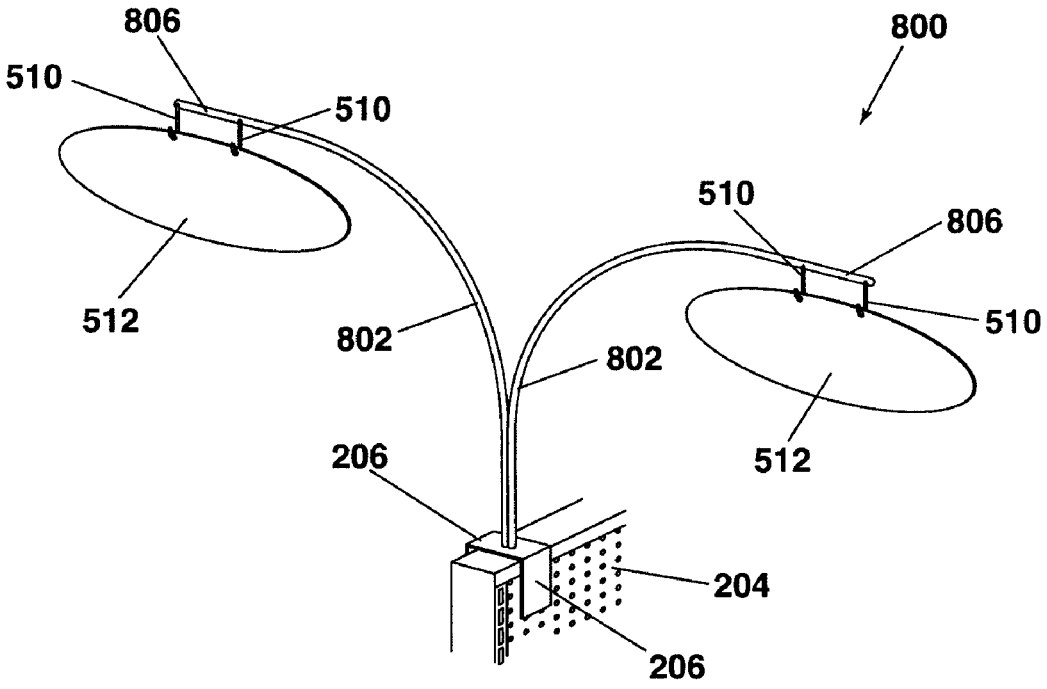
FIG. 12 is a perspective view of another overhead signage system according to the present teachings.

Turning to FIG. 12, another overhead signage system in accordance with the present teachings is illustrated and identified at reference character 800. Like reference characters will be used to identify similar elements to those previously introduced. The system 800 may include a pair of wire arms arm 802. The wire arms 802 may be secured at their lower ends to one another and to a C-shaped member 206 for engaging an upper end of a pegboard wall 204. The member 206 may be secured with a thumb screw. The wire arms 802 may be welded or otherwise permanently or removably secured to the member 206. The arms 802 may be arcuate in shape. Ends 806 of the arms 802 may each carry one or more hooks 510 for supporting a sign 512.

The foregoing discussion discloses and describes merely exemplary arrangements of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A system for supporting one or more contiguous overhead signs or portions thereof, the system comprising:

a first support member comprising a panel having first and second surfaces, wherein the first surface defines a clip for supporting the sign, and the second surface defines a first longitudinal channel; and a first arm for supporting the first support member on a support surface, the first arm comprising a thin elongated member having first and second ends, a first end segment adjacent to the first end, and a central portion between the first end segment and the second end, the first end segment pivotably received in a bore of a mounting bracket attachable to a support surface, the end segment oriented out of plane relative to the central segment, the central segment defining an acute angle relative to the longitudinal channel, the second end integrally attached to a first connector, the first connector shaped as a plate, the connector slidably receivable in the longitudinal channel of the support member.

2. The system of claim 1, wherein the clip is C-shaped.

3. The system of claim 2, wherein the panel is curved.

4. The system of claim 1, wherein the connector is a thin rectangular plate.

5. The system of claim 1, further comprising a second connector shaped as a plate, the second connector received in a second longitudinal channel of the first support member and a third longitudinal channel of a second support member, the second support member adjacent the first support member along a common longitudinal axis of the first and second support members.

6. A system for supporting one or more overhead signs or portions thereof, the system comprising:

a plurality of mounting brackets couplable to a support surface;

a plurality of sign support members, each support member comprising a panel having first and second surfaces, wherein the first surface defines first and second C-shaped clips for supporting the sign therebetween, and the second surface defines at least one longitudinal channel;

a plurality of arms coupled to the support members and configured for suspending the sign; and a plurality of connectors, each connector shaped as a thin rectangular plate, at least one connector of the plurality of connectors slidably receivable by adjacent support members in corresponding aligned longitudinal channels thereon for coupling the adjacent support members along a common longitudinal axis;

wherein each arm is coupled to a corresponding support member by a corresponding connector slidably receivable in a corresponding longitudinal channel of the support member;

wherein each arm comprising a thin elongated member having first and second ends, a first end segment adjacent to the first end, and a central portion between the first end segment and the second end, the first end segment pivotably received in a bore of a corresponding mounting bracket, the end segment oriented out of plane relative to the central segment, the central segment defining an acute angle relative to the longitudinal channel, the second end integrally attached to a corresponding connector.

7. The system of claim 6, wherein the thin rectangular plate is planar.

* * * * *